United States Patent [19]

Tolan

[11] 4,063,322

[45] Dec. 20, 1977

[54] HAWSER FLOAT ASSEMBLY

[75] Inventor: Peter John Tolan, Scituate, Mass.

[73] Assignee: The B. F. Goodrich Company, Akron, Ohio

[21] Appl. No.: 742,979

[22] Filed: Nov. 18, 1976

[51] Int. Cl.[2] ..... B63B 21/04

[52] U.S. Cl. ..... 9/8 R; 114/267

[58] Field of Search ..... 9/8 R, 8 P, 1.6; 114/230, 253, 267, 244, 264, 266; 61/1 F; 43/44.91, 44.92, 44.93

[56] References Cited

U.S. PATENT DOCUMENTS

| | | | |
|---|---|---|---|
| 2,395,892 | 3/1946 | Lontz | 114/253 X |
| 3,729,756 | 5/1973 | Cook et al. | 9/8 R |

FOREIGN PATENT DOCUMENTS

| | | | |
|---|---|---|---|
| 2,444,591 | 3/1975 | Germany | 114/253 |

*Primary Examiner*—Trygve M. Blix
*Assistant Examiner*—Edward M. Wacyra
*Attorney, Agent, or Firm*—Harry F. Pepper, Jr.; W. A. Shira, Jr.

[57] ABSTRACT

An assembly adapted to float a length of mooring hawser upon water comprises a pair of water tight, buoyant, elongated tubes spaced from each other along mutually parallel axes and interconnected by a plurality of spaced transversely extending hawser supports. Removable clamps mounted on fasteners extending from each mooring line support are provided to hold a length of hawser.

8 Claims, 4 Drawing Figures

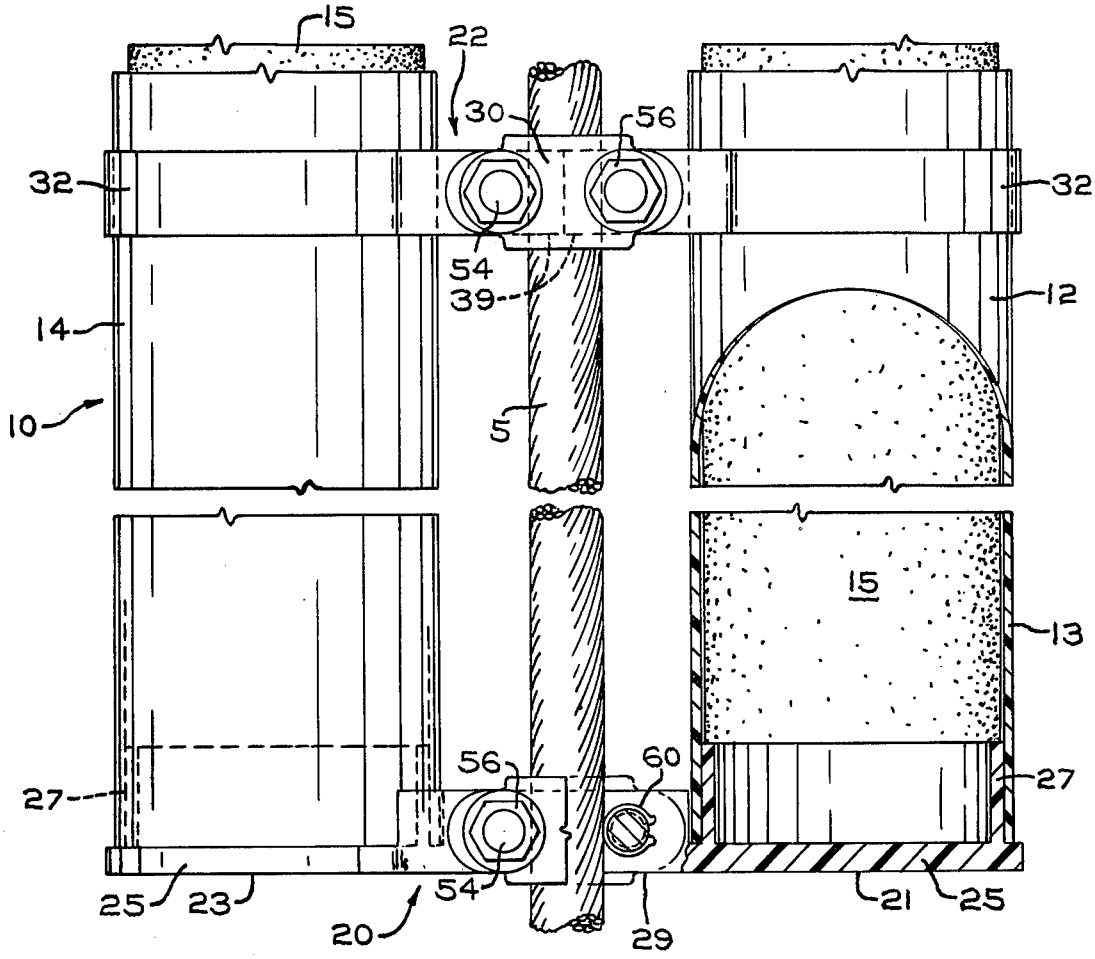
FIG. 2
FIG. 3
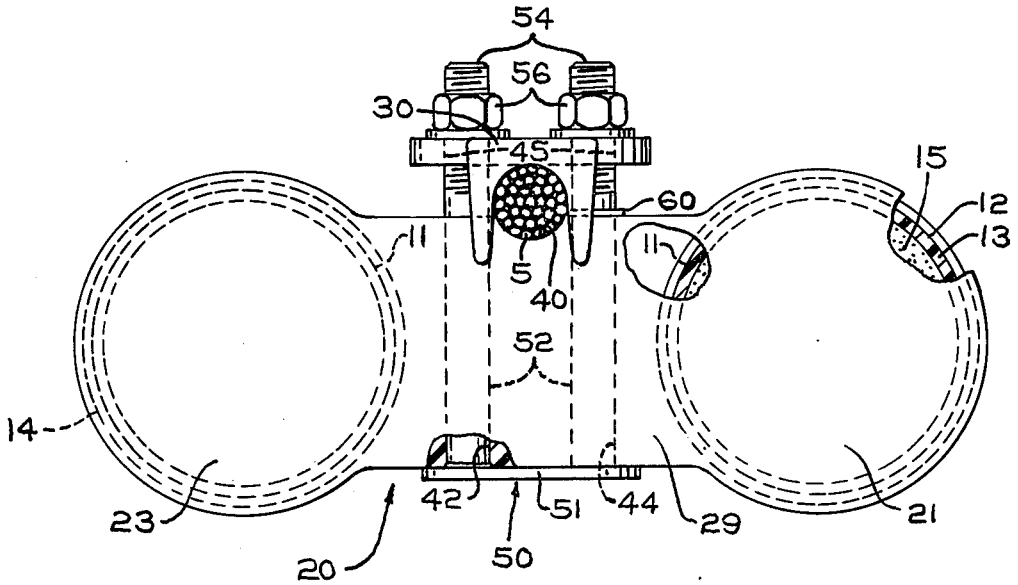

HAWSER FLOAT ASSEMBLY

BACKGROUND

The invention relates to a float or buoying structure and particularly to such a structure adapted to float a length of mooring line or hawser.

It is often desirable that mooring lines or hawsers be made to float on the water surface. In off-shore mooring systems, where long lengths of mooring hawsers are used between the shore and a distant off-shore pier or dock, it is particularly advantageous that at least portions of the hawser around the pier or dock be floated so as to be visible. Also, it is desirable that particular lengths of the hawser can be moved along the water surface to different positions around the pier area to allow for unobstructed movement of other vessels into and around the pier. Floating substantial lengths of hawsers allows the position of the hawser in the water to be easily discerned so that movement around the hawser, repositioning of the hawser, or hook-up to the hawser is more readily achieved.

Many off-shore mooring systems utilize hawsers of heavy steel cable which are difficult to float. Flotation collars, (cylindrical buoyant structures wrapped around a section of hawser), while satisfactory for some lighter weight hawsers, have not been entirely satisfactory for use in floating some of the more heavy and larger diameter hawsers as are often used in off-shore mooring systems.

SUMMARY

It is an object of the present invention to provide an improved float assembly for mooring line or hawser.

It is a further object to provide a hawser float assembly capable of use with hawsers of significant weight and thickness.

It is still another object of the present invention to provide a mooring hawser float assembly which is easily attached to and/or detached from the hawser.

The above objects and other objects which will be evident from the whole of this specification are achieved by an assembly which comprises a pair of buoyant, elongated tubular members which are spaced from each other and disposed along substantially mutually parallel axes. The tubular members are interconnected by longitudinally spaced, hawser support members extending transversely between the tubular members. Substantially midway between the tubular members the surface of each of the hawser support members is adapted to receive and support a section of hawser. Means such as a clamp, attachable and removable from above each hawser support member, is provided to hold the hawser on each hawser support member.

BRIEF DESCRIPTION OF THE DRAWINGS

In the drawings which depict the invention in accordance with a presently preferred embodiment:

FIG. 2 is a top view of a portion of the float assembly depicted by FIG. 1 with portions thereof omitted, broken away and shown in section;

FIG. 3 is an end view of the float assembly as shown in FIG. 2, with portions broken away and/or omitted.

DETAILED DESCRIPTION

Figure 1:
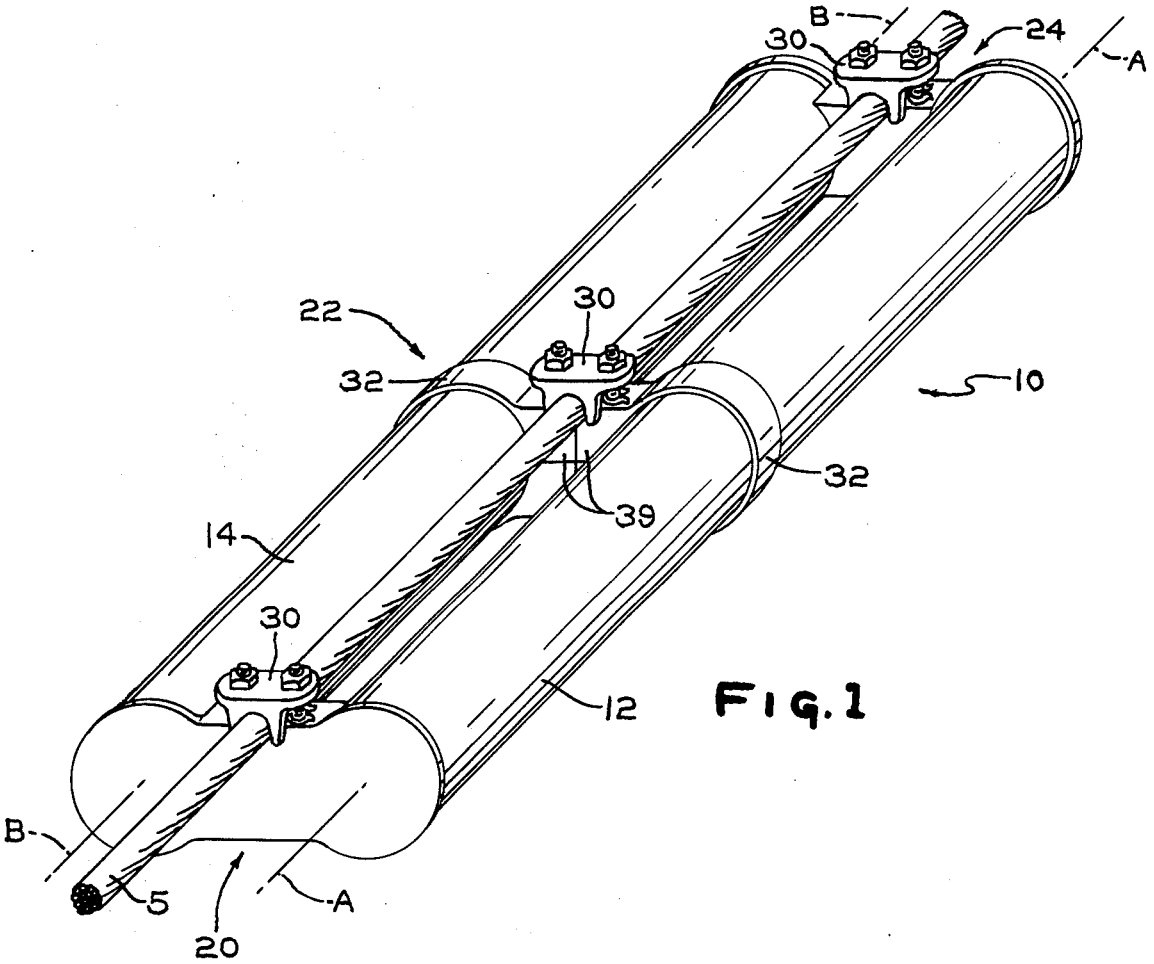
FIG. 1 is a perspective view of a hawser float assembly having a portion of steel hawser secured thereto.

As seen in FIG. 1, a hawser float assembly 10 is shown with a length of steel cable type hawser 5 held thereon. The float assembly 10 basically comprises a pair of buoyant, spaced tubular members 12 and 14 substantially equal in length and diameter, which members 12 and 14 are spaced from each other with their respective longitudinal axes A and B in substantially mutually parallel alignment. Holding the tubular members 12 and 14 in the position shown and interconnecting the same are three transversely extending longitudinally spaced hawser support members 20, 22 and 24. U-shaped clamps 30 hold the hawser 5 in position on each hawser support 20, 22 and 24 in a manner to be more fully described hereinafter. It is understood that more than two tubular members could be used for float assembly 10. For example, an interconnected plurality of parallel transversely spaced tubular members could be disposed on each side of hawser supports 20, 22 and 24. Also, a pair of pluralities of longitudinally connected tubular members could be used rather than single members 12 and 14.

Referring to FIGS. 2 and 3 wherein further details of the float assembly 10 are shown, each tubular member 12 and 14 preferably is comprised of a thin sheet 13 of suitable plastic such as polyvinyl chloride which is shaped so that its marginal portions 11 join to form a cylinder. Each tubular member 12 and 14 is preferably filled with a suitable quantity of closed cell foam 15.

The transverse support members 20 and 24 which are at each end of the assembly 10 are identical and each comprise, as seen in FIGS. 2 and 3 which shows support member 20 only, a pair of laterally spaced cap portions 21 and 23. Each cap portion 21 and 23 comprises a circular end wall 25 and an annular, cylindrical flange portion 27 extending therefrom, which flange portion fits within each open end of each tubular member 12 and 14. The cap portions such as 21 and 23 are secured in sealed relation to tubular members 12 and 14 using, for example, suitable adhesives and ring nailing.

Integral with and extending between each of the cap portions such as 21 and 23 of end supports 20 and 24 is a bridging portion 29. Bridging portion 29 has a hawser seat 40 formed in the middle of its upper surface and two vertically extending bores 42 and 44 extending therethrough, one of each of said bores being disposed on either side of hawser seat 40.

Figure 4:
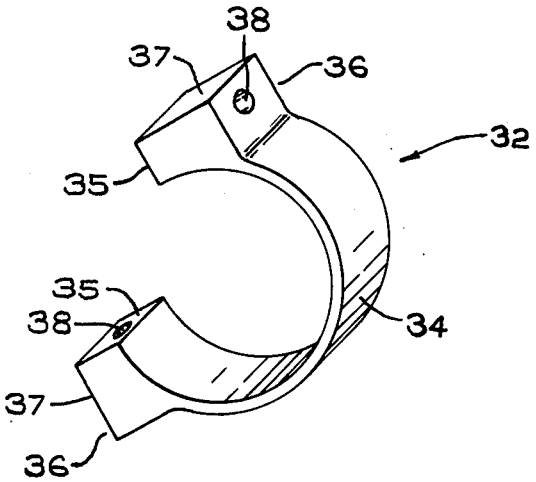
FIG. 4 is a perspective view of a portion of a hawser support member which forms part of the float assembly.

Because hawser support 22 is disposed longitudinally between the ends of assembly 10, its construction differs from that of hawser supports 20 and 24. Hawser support 22 is of two-piece construction and consists of a pair of identical collar portions 32, one of which is shown in FIG. 4. Referring to FIG. 4, each collar portion 32 comprises a loop 34 and two thickened lugs 36, one at each end of looped portion 34. Each lug 36 is provided with an opening or bore 38 therethrough which will mutually align when the lugs are brought together such that surfaces 35 of each lug meet. When lugs 36 are brought together in such a manner, surfaces 37 of each lug align and form a mating face for the other identical collar portion which together form the hawser support member 22. The mating of these four lugs 36 in the manner shown in FIG. 1 form a bridging portion 39 between the two loops 34 of the collars 32 which respectively engage the outer surface of each tubular member 12 and 14. The hawser 5 is supported midway between the bridging portion 39 of hawser support 22 with the bores 38 in each lug 36 aligning to effect a vertical bore opening through the bridging portion 39 located on either side of the point of support for the hawser 5. Each of the support members 20, 22 and 24 are preferably of a non-metallic material such as urethane.

A fastening member 50 is shown operatively associated with hawser support member 20. Fastening member 50 comprises a metal support plate 51 from which a pair of fastening rods 52 vertically extend through openings 42 and 44 in bridging portion 29 of hawser support 20. Each fastening rod 52 is provided with a threaded end 54 for receiving a nut 56. U-shaped clamp 30 having suitable bores 45 therethrough is adapted to fit upon the fastening rods and be tightened down by nuts 56 to hold hawser 5 against the hawser support 20. A lock clip or ring 60 is preferably located between the clamp 60 and the hawser support 20 to prevent fastening member 50 from falling back through openings 42 and 44 in hawser support 20 when nuts 56 and clamps 30 are removed. A fastening device such as 50 is associated with each of hawser supports 22 and 24 in the same manner just described such that each hawser support is provided with a clamp 30 as described.

By varying the lengths of tubes 12 and 14, or the number of such tubes as mentioned previously, and the span of hawser supports 20, 22 and 24 between the tubular members, a float assembly of selected length and/or width is possible. For typical heavy steel cable used in off-shore mooring systems, a suitable float assembly can have an overall length of about 72 in. (182.9 cm) and an overall width of about 18.1 in. (45.9 cm). The diameter of each tubular members in such an assembly would be about 6 in. (15.2 cm) and the space between such tubular members would be about 5.5 in. (13.9 cm). An assembly with these dimensions could typically weigh about 72 lb. (32.6 kg). For optimum performance assemblies of the aforementioned size should preferably be spaced at about 6 ft. (1.8 m) intervals along the length of the mooring cable to be floated.

It is understood that the foregoing details are illustrative of the invention in accordance with a presently preferred embodiment and that modifications of and departures from such details can be made which would be included within the scope of the present invention as measured by the following claims.

I claim:

1. An assembly adapted to float a length of mooring hawser, said assembly comprising:

A. at least two buoyant, elongated, tubular members
  1. spaced from each other and
  2. disposed along substantially mutually parallel, longitudinal axes;

B. a plurality of longitudinally spaced hawser support members extending transversely between and interconnecting said tubular members, each of the support members comprising
  1. laterally spaced end portions, each secured to a respective one of said tubular members to maintain said members in their spaced relationship, and
  2. a bridging portion
    a. extending between said end portions across the space between said tubular members and
    b. having an upper surface adapted to support a portion of said hawser length equidistant between the longitudinal axes of said tubular members; and C. means adapted to hold a portion of hawser length on each of said upper surfaces of said bridging portions.

2. The assembly defined in claim 1 where said tubular members and said hawser support members are nonmetallic materials.

3. The assembly defined in claim 1 further comprising an elongated body of closed cell foam material encased within each tubular member.

4. The assembly defined in claim 3 wherein said tubular members and said hawser support members are nonmetallic material.

5. The assembly defined in claim 1 wherein the means adapted to hold a length of hawser on each of said hawser support members includes A. a pair of transversely spaced fasteners projecting vertically from the surface of each hawser support member and B. a removable rigid clamp secured to each pair of fasteners.

6. The assembly defined in claim 5 wherein said tubular members and said hawser support members are nonmetallic materials.

7. The assembly defined in claim 5 further comprising an elongated body of closed cell foam material encased within each tubular member.

8. The assembly defined in claim 7 wherein said tubular members and said hawser support members are nonmetallic material.

* * * * *